US006479803B2

(12) United States Patent
Lee et al.

(10) Patent No.: US 6,479,803 B2
(45) Date of Patent: Nov. 12, 2002

(54) MICROWAVE OVEN AND CONTROL METHOD THEREOF

(75) Inventors: Sung-ho Lee; Young-won Cho, both of Suwon; Tae-soo Kim, Seoul, all of (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/887,062

(22) Filed: Jun. 25, 2001

(65) Prior Publication Data

US 2002/0066729 A1 Jun. 6, 2002

(30) Foreign Application Priority Data

Dec. 6, 2000 (KR) ..... 00-73917

(51) Int. Cl.[7] ..... H05B 6/68
(52) U.S. Cl. ..... 219/702; 219/715
(58) Field of Search ..... 219/702, 715, 219/716, 719, 721, 710, 720, 723, 761, 601; 363/23, 37, 55, 177; 318/778

(56) References Cited

U.S. PATENT DOCUMENTS 4,734,634 A * 3/1988 Kito et al. ..... 318/778
4,900,884 A * 2/1990 Aoki ..... 219/601
5,021,620 A * 6/1991 Inumada ..... 219/716
5,274,208 A * 12/1993 Noda ..... 219/715
5,451,750 A * 9/1995 An ..... 219/716

FOREIGN PATENT DOCUMENTS

| | | |
|---|---|---|
| JP | 1288782 | 10/1999 |
| KR | 1991-11087 | 6/1991 |
| KR | 1993-24536 | 12/1993 |
| KR | 1994-4685 | 2/1994 |

* cited by examiner

*Primary Examiner*—Teresa Walberg
*Assistant Examiner*—Quang Van
(74) *Attorney, Agent, or Firm*—Robert E. Bushnell, Esq.

(57) ABSTRACT

Disclosed is a microwave oven including a magnetron, a power supply part supplying an AC power and a high voltage transformer generating a high voltage with the AC power from the power supply part, comprising a power controller part interrupting the power supply to the magnetron where it is determined that the voltage of the power supplied from the power supply part is lower than a predetermined allowable lower limit voltage. With this configuration, application of the voltage lower than the allowable lower limit voltage can be prevented, and in addition, the stability of the circuit can be enhanced.

24 Claims, 5 Drawing Sheets

MICROWAVE OVEN AND CONTROL METHOD THEREOF

This application makes reference to, incorporates the same herein, and claims all benefits accruing under 35 U.S.C. §119 from an application from MICROWAVE OVEN AND CONTROL METHOD THEREOF earlier filed in the Korean Industrial Property Office on Dec. 6, 2000 and there duly assigned Ser. No. 73917/2000 by that Office.

BACKGROUND OF THE INVENTION

1. Field of the Invention

The present invention relates in general to a microwave oven and a method of controlling the same, and more particularly, to a microwave oven and a method of controlling the same, which is able to prevent an application of a lower voltage than an allowable lower limit voltage.

2. Description of the Related Art

Conventionally, a microwave oven is operated in the following process. An alternating current (AC) power supplied from a power supply part is applied to a primary coil of a high voltage transformer, and a high voltage is then generated in a secondary coil thereof. The high voltage generated in the secondary coil of the high voltage transformer is used to heat a cathode filament provided in a magnetron, the magnetron is then oscillated by the applied high voltage, and a very high frequency energy is then radiated. The very high frequency energy is transformed into heat energy when it encounters with water or water-containing objects (for example, foodstuff, etc.) within a closed space, and the heat energy is used for cooking.

FIG. 5 is a schematic block diagram showing a control process of a conventional microwave oven. As illustrated therein, the conventional microwave oven is comprised of a power supply part 101 supplying an alternating current (AC) power, a magnetron 109 generating electromagnetic waves with a high voltage generated from a high voltage transformer 107, a rectifier and smoother part 103 rectifying and smoothing the AC power, an inverter part 105 converting a direct current (DC) power from the rectifier and smoother part 103 into an AC power of a high frequency, the high voltage transformer 107 generating the high voltage with the AC power supplied from the power supply part 101 through the rectifier and smoother part 103 and the inverter part 105, a signal generator part 127 generating a control signal, and an inverter controller part 115 interposed between the inverter part 105 and the signal generator part 107.

The inverter controller part 115 includes a digital/analog (D/A) converter part 125 converting the control signal generated from the signal generator part 127 into an analog signal and applying the converted control signal to a resonance detector part 121, an output control part 119 controlling a frequency of the control signal detected by the resonance detector part 121 to output it, and an oscillator part 117 changing a cycle of the control signal outputted from the output control part 119 according to the frequency thereof and inputting the changed cycle into the inverter part 105. The inverter controller part 115 further includes an on-off starter part 123 controlling on-off operations and a soft start operation of the oscillator part 117 according to the control signal generated from the signal generator part 127.

However, where the voltage of the AC power inputted from the power supply part is lower than an allowable lower limit voltage, the high voltage generated in the secondary coil of the high voltage transformer is relatively lowered. Accordingly, an efficiency of generating the electromagnetic waves in the magnetron is lowered, and the cooking time is relatively lengthened.

In addition, where a value of the current smoothed through the rectifier and smoother part exceeds a predetermined allowable current value, the circuit is overloaded, thereby being liable to lower a stability of the overall circuitry.

SUMMARY OF THE INVENTION

Accordingly, the present invention has been made keeping in mind the above-shortcoming, and an object of the present invention is to provide a microwave oven and a method of controlling the same, which is able to interrupt a power having a voltage lower than an allowable voltage from being inputted, and increase an efficiency of outputting a frequency from the magnetron.

This and other objects of the present invention may be accomplished by the provision of a microwave oven including a magnetron, a power supply part supplying an AC power and a high voltage transformer generating a high voltage with the AC power from the power supply part, comprising a power controller part interrupting the power supply to the magnetron where it is determined that the voltage of the power supplied from the power supply part is lower than a predetermined allowable lower limit voltage.

The microwave oven further comprises a rectifier and smoother part rectifying and smoothing the AC power; an inverter part converting a DC power from the rectifier and smoother part into an AC power having a high voltage; and an inverter controller part interrupting the power supply to the magnetron where it is determined that the voltage of the power supplied from the power supply part is lower than the predetermined allowable lower limit voltage.

Preferably, the power controller part determines whether the current value of the power inputted into the high voltage transformer exceeds a predetermined allowable current value, interrupts the power from the power supply part being inputted into the magnetron where the current value is in excess of the allowable current value, and resumes an operation of the magnetron after a predetermined period of time for recess has passed.

The power controller part interrupts the power supply to the magnetron where the voltage of the power supplied from the power supply part exceeds a predetermined allowable upper limit voltage, thereby enhancing a stability of a circuitry.

Preferably, the power controller part further includes a comparator comparing the voltage of the power supplied from the power supply part with the predetermined allowable lower limit voltage to determine whether the voltage of the supplied power is lower that the allowable lower limit voltage.

According to another aspect of the present invention, this and other objects of the present invention may also be accomplished by the provision of a method of controlling a microwave oven including a magnetron, a power supply part supplying an AC power and a high voltage transformer generating a high voltage with the AC power from the power supply part, comprising the steps of determining whether the voltage of the power supplied from the power supply part is lower than a predetermined allowable lower limit voltage; and interrupting the power supply to be applied to the magnetron where it is determined that the voltage of the power supplied from the power supply part is lower than the predetermined allowable lower limit voltage.

Effectively, the method further comprises the steps of determining whether the voltage of the power supplied from the power supply part exceeds a predetermined allowable upper limit voltage; and interrupting the power supply to be applied to the magnetron where it is determined that the voltage of the power supplied from the power supply part exceeds the predetermined allowable upper limit voltage.

The method further comprises the steps of determining whether the current value of the power inputted into the high voltage transformer exceeds the predetermined allowable current value; and interrupting the power supply to the magnetron where it is determined that the current value of the power is in excess of the allowable current value, and resuming an operation of the magnetron after a predetermined period of time for recess has passed, thereby enhancing a stability of a circuitry.

Preferably, a comparator compares the voltage of the power supply with the allowable voltage determines whether the voltage of the power supply is lower than the predetermined allowable voltage.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Hereinbelow, the present invention will be described in more detail with reference to the accompanying drawings.

Figure 1:
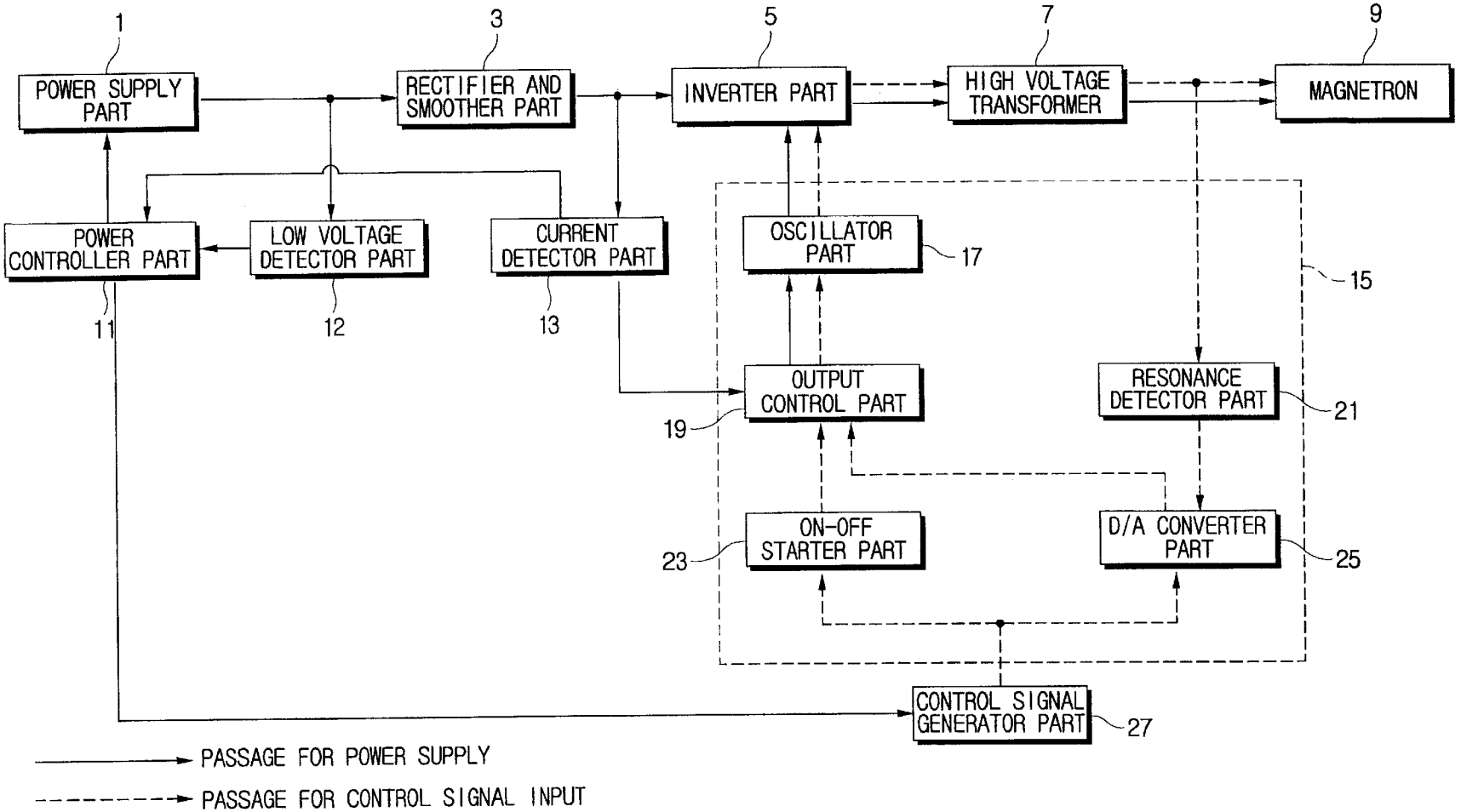
FIG. 1 is a control block diagram of a microwave oven according to the present invention.

Referring to FIG. 1 which is a control block diagram of a microwave oven according to the present invention, the microwave oven is comprised of a power supply part 1 supplying an alternating current (AC) power, a high voltage transformer 7 generating a high voltage with the AC power supplied from the power supply part 1, and a magnetron 9 generating electromagnetic waves with the high voltage generated from the high voltage transformer 7. The microwave oven further includes a low voltage detector part 12 determining whether a voltage of the power supplied from the power supply part 1 is lower than a predetermined allowable lower limit voltage, and a current detector part 13 determining whether a current value of the power inputted into the high voltage transformer 7 exceeds a predetermined allowable current value.

In the microwave oven is provided a power controller part 11 interrupting a power from the power supply part 1 from being applied to the magnetron 9 where the voltage of the power supplied from the power supply part 1 is lower than the predetermined allowable lower limit voltage. The power controller part 11 interrupts the power to be inputted into the magnetron 9 where the current value of the power inputted into the high voltage transformer 7 exceeds the allowable current value, and resumes an operation of the magnetron 9 after a predetermined period of time for recess has passed. Further, the power controller part 11 also interrupts the power from the power supply part 1 being inputted into the magnetron 9 where the voltage of the power supplied from the power supply part 1 is in excess of a predetermined allowable upper limit voltage.

The microwave oven according to the present invention further includes a rectifier and smoother part 3 rectifying and smoothing an AC power, an inverter part 5 converting a direct current (DC) power from the rectifier and smoother part 3 into an AC power having a high frequency, a control signal generator part 27 generating a control signal, an inverter controller part 15 determining whether the current value of the DC power from the current detector part 13 via the rectifier and smoother part 3 exceeds the predetermined allowable current value, interrupting the power being inputted into the magnetron 9 where the current value of the DC power is in excess of the allowable current value, and resuming an operation of the magnetron 9 after the predetermined period of time for recess has passed.

The inverter controller part 15 includes a digital/analog (D/A) converter part 25 converting the control signal generated from the signal generator part 27 into an analog signal and applying the converted control signal to a resonance detector part 21, an output control part 19 controlling a frequency of the control signal detected by the resonance detector part 21 to output it, and an oscillator part 17 changing a cycle of the control signal outputted from the output control part 19 according to the frequency thereof and inputting the changed cycle into the inverter part 5. The inverter controller part 15 further includes an on-off starter part 23 controlling on-off operations and a soft start operation of the oscillator part 17 according to the control signal generated from the signal generator part 27.

Although it has not been shown in FIG. 1, a high voltage detector part may be further provided, the high voltage detector part determining whether the voltage of the AC power supplied from the power supply part 1 exceeds the set up allowable upper limit voltage.

Figure 2:
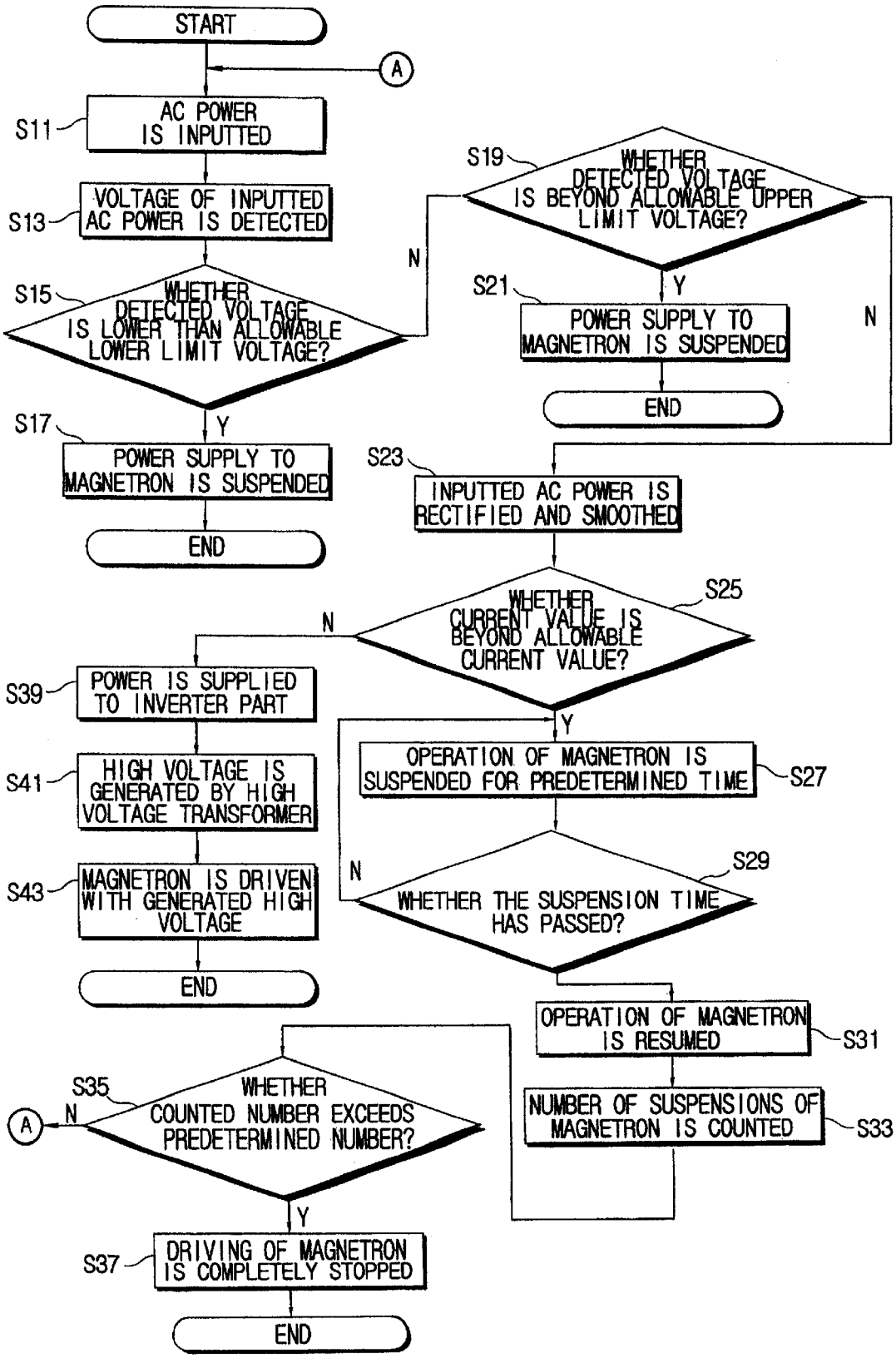
FIG. 2 is a flow chart showing a control process of the microwave oven of FIG. 1.

Referring to FIG. 2 showing a control process of the microwave oven according to the present invention, the control process will be described.

An Ac power is supplied from the power supply part (S11). When the AC power is inputted, the voltage of the inputted AC power is detected (S13). It is determined whether the detected voltage is lower than the allowable lower limit voltage (S15). If it is determined that the detected voltage is lower than the allowable lower limit voltage, the power controller part 11 stops the power supply to the magnetron (S17). If it is determined that the detected voltage is not lower than the allowable lower limit voltage, it is determined whether the detected voltage exceeds the allowable upper limit voltage (S19). If it is determined that the detected voltage is in excess of the allowable upper limit voltage, the power supply to the magnetron 9 is suspended (S21).

If it is detected that the detected voltage is not in excess of the allowable upper limit voltage, the AC power inputted from the power controller part 11 is converted into a DC power through the rectifier and smoother part 3 (S23). After the AC power is converted into the DC power through the rectifier and smoother part 3, it is determined whether the current value of the DC power exceeds the predetermined allowable current value (S25). If it is determined that the current value of the DC power is in excess of the predetermined allowable current value, the power controller part 11 suspends the input of the power into the magnetron 9 for a predetermined period of time (S27). If it is determined that the predetermined period of time for recess has passed, the operation of the magnetron is resumed (S29). The number of recesses and resumptions of the magnetron 9 is counted (S31), and it is determined whether the counted number of recesses and resumptions of the magnetron 9 exceeds a predetermined number (S33). If it is determined that the counted number of recesses and resumptions of the magnetron is in excess of the predetermined number, the magnetron 9 is completely interrupted from being operated (S35).

If it is determined that the current value of the DC power is not beyond the predetermined allowable current value in the step S25, the DC power converted from the AC power is supplied to the inverter part 5 (S39). The power supplied to the inverter part 5 is applied to the high voltage transformer 7, generating a high voltage (S41). The high voltage generated in the high voltage transformer 7 is applied to the magnetron 7, generating electromagnetic waves (S39).

Figure 3:
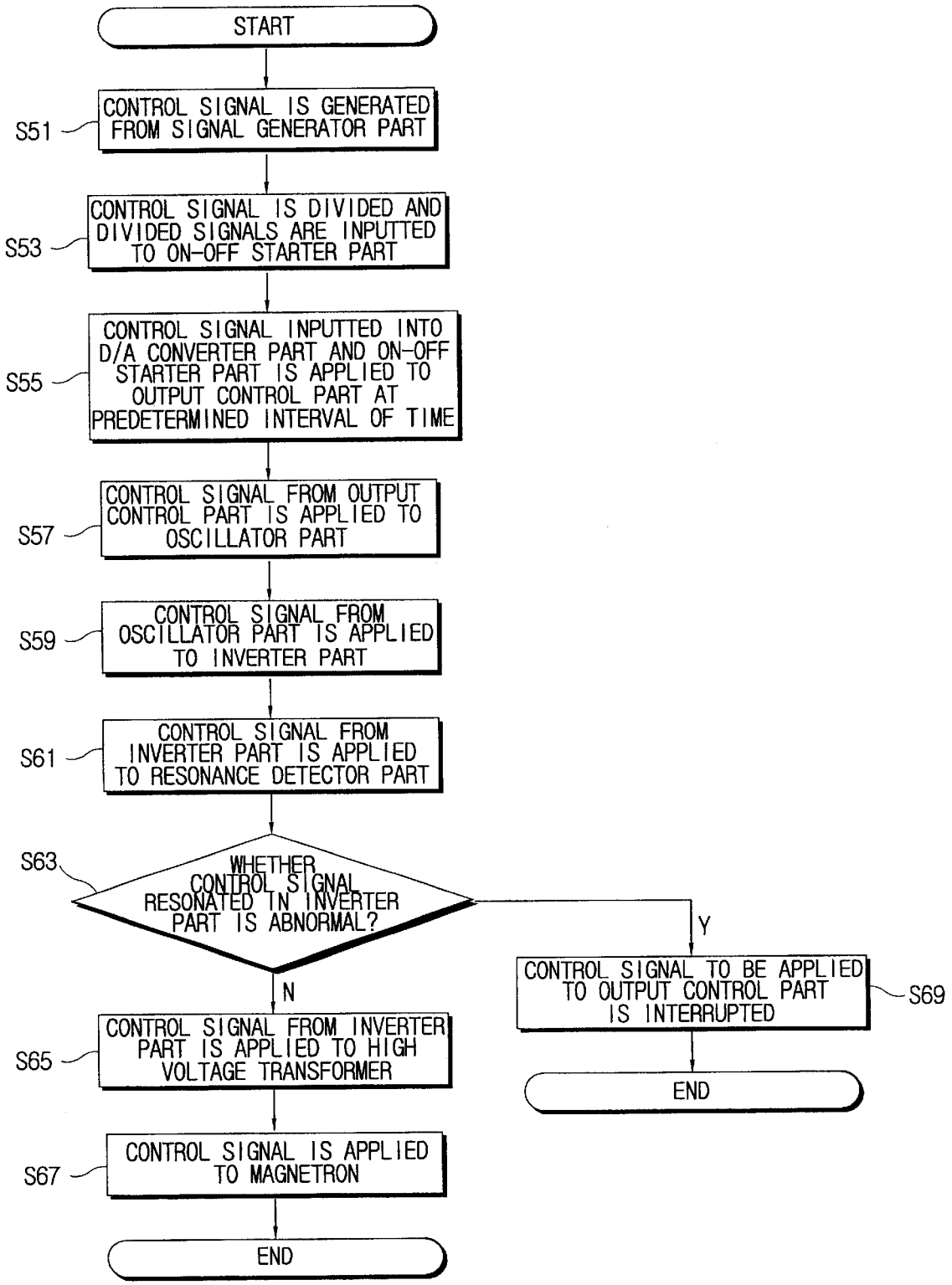
FIG. 3 is a flow chart showing in detail a normal current inflow in the control process of FIG. 2.

FIG. 3 is a flow chart showing in detail a normal current inflow in the control process according to the present invention. As illustrated therein, a control signal is generated from the signal generator part 27 simultaneously with the power supply from the power supply part 1 (S51). The control signal generated from the signal generator part 27 is divided by the inverter controller part 15 and applied to the on-off start part 23 and the D/A converter part 25 (S53). The control signal dividedly applied to the DA converter part 25 and the on-off start part 23 is applied to the output control part 21 at a predetermined interval of time (S55). The control signal passing through the output control part 21 is applied to an input terminal of the oscillator part 17 (S57). A cycle of the control signal passing through the oscillator part 17 is changed, and the cycle-changed control signal is applied to the inverter part 5 (S59).

The control signal passing through the inverter part 5 is applied to the resonance detector part 21 (S61). The inverter controller part 15 determines whether the control signal detected by the resonance detector part 21 is abnormal (S63). If it is determined that the control signal detected by the resonance detector part 21 is abnormal, the inverter controller part 15 interrupts the control signal from applying to the output control part 19 (S69).

If it is determined that the control signal detected by the resonance detector part 21 is not abnormal, the inverter controller part 15 controls the control signal passing through the inverter part 5 to be applied to the output control part 19, and the DC power through the rectifier and smoother part 3 is converted into the AC power having a high frequency, based on the control signal applied to the inverter part 5. The converted AC power of the high frequency is applied to the high voltage transformer 7, generating a high voltage, and the control signal passing through the high voltage transformer 7 is applied to the magnetron (S65).

In order to determine whether the inputted control signal is abnormal, the control signal applied to the magnetron 9 through the high voltage transformer 7 may be applied to the resonance detector part 21. If it is determined that a resonance frequency of the control signal applied to the resonance detector 21 is not beyond a set up resonance frequency, the inverter controller part 15 controls the control signal to be applied to the output control part 19 and repeats the steps S57 through S63 in the control process to be applied to the oscillator part 17 and the inverter part 5.

Figure 4:
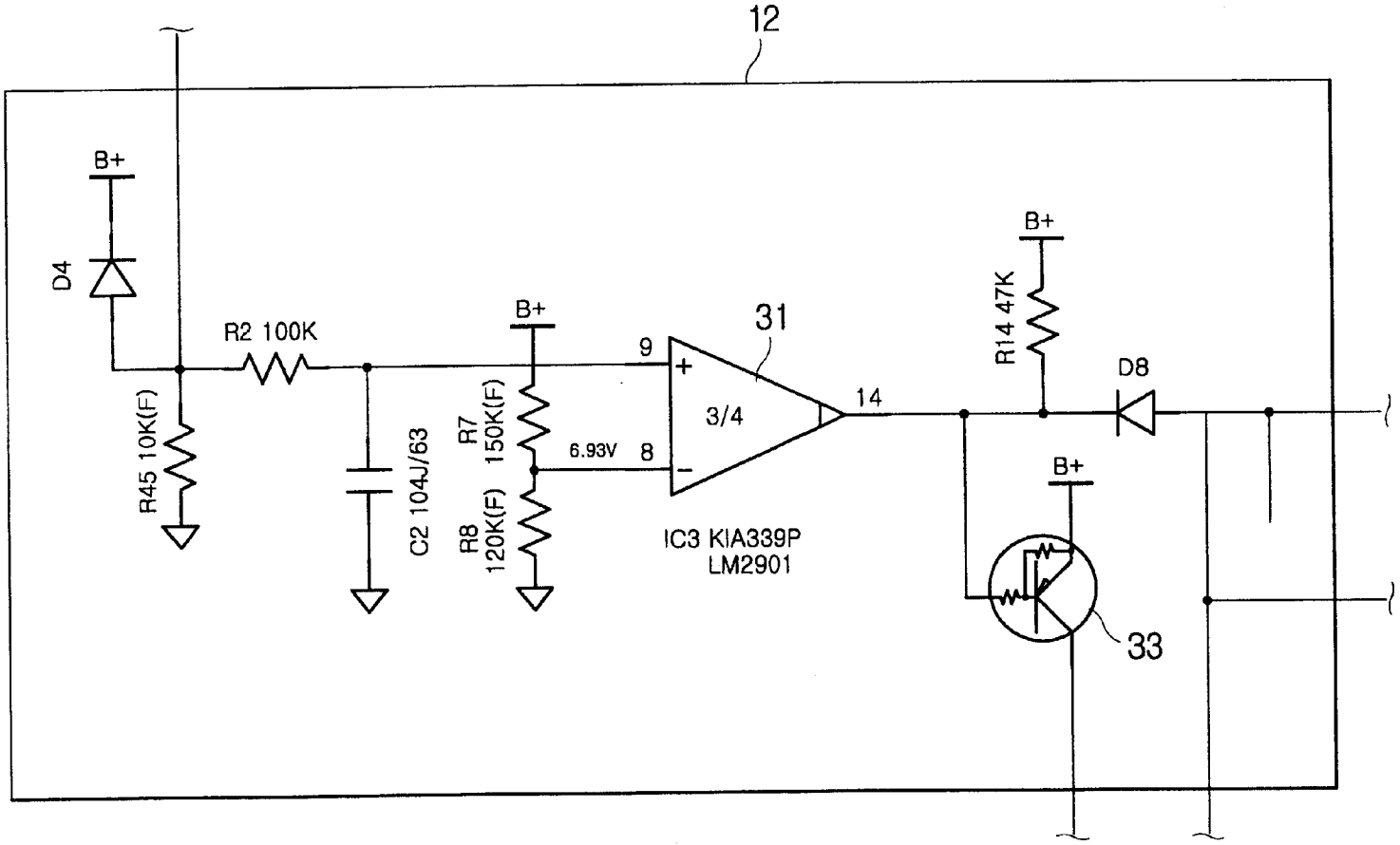
FIG. 4 is a detailed circuit diagram of a lower voltage detector part according to the present invention.
Figure 5:
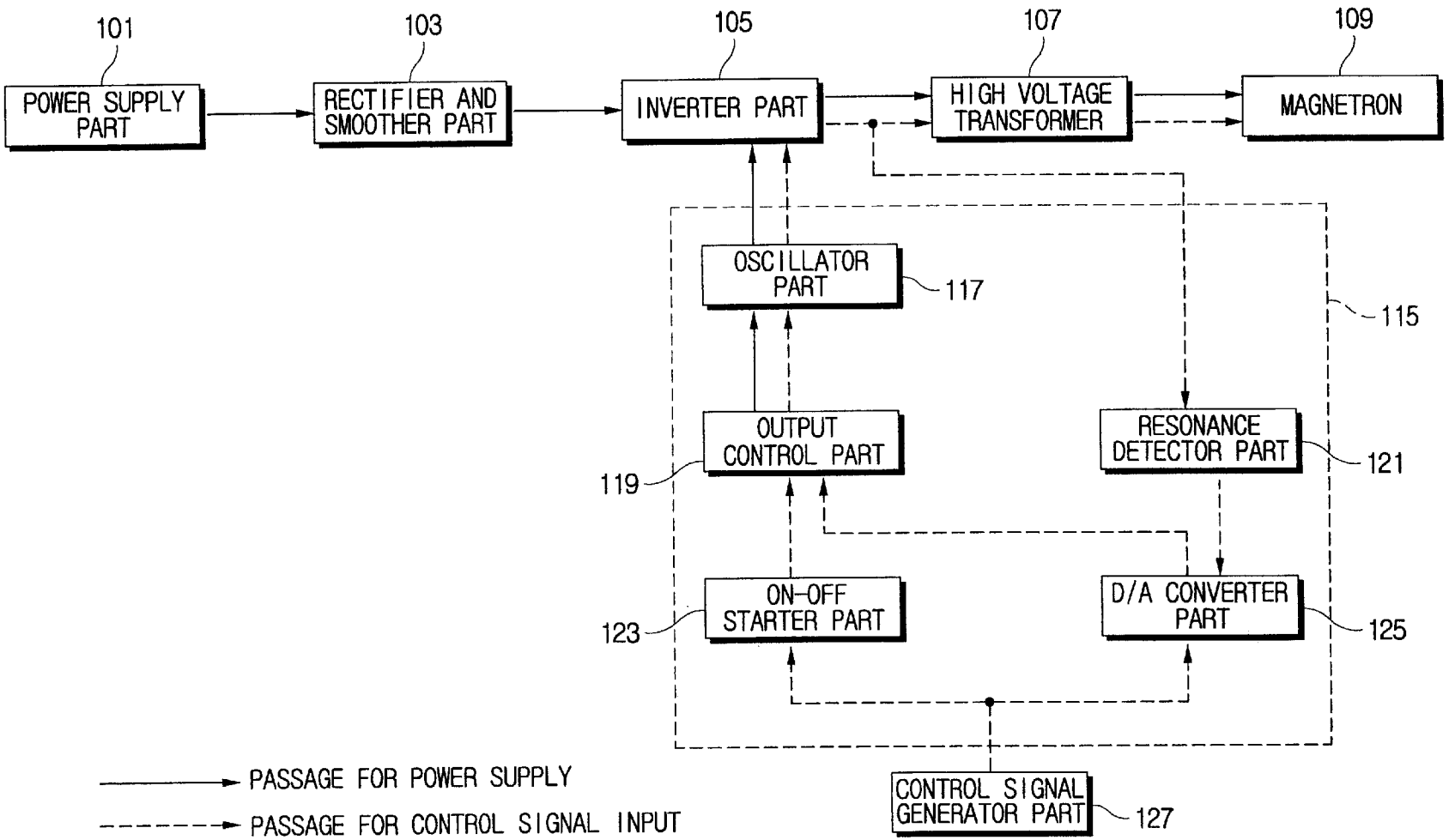
FIG. 5 (PRIOR ART)
FIG. 5 is a schematic control block diagram of a conventional microwave oven.

FIG. 4 is a detailed circuit diagram of a lower voltage detector part according to the present invention. Referring to this figure, the lower voltage detector part 12 includes a comparator 31 comparing the voltage of the AC power supplied from the power supply part 1 with the predetermined allowable lower limit voltage, and a transistor 33 adjusting the power to be applied to or interrupted from the magnetron 9 according to the voltage value compared by the comparator 31. The comparator 31 compares the voltage of the AC power with the allowable lower limit voltage, and controls the AC power applied from the power supply part 1 so as not to be applied to the magnetron 9 where the voltage of the AC power is lower than the predetermined allowable lower limit.

As described above, the present invention prevents a driving efficiency of the magnetron from being lowered due to the input of the allowable lower limit voltage, by comprising the power controller part able to interrupt the power supply applied to the magnetron where it is determined that the voltage of the power supplied from the power supply part is lower than the predetermined allowable lower limit voltage.

According to the present invention, application of the voltage lower than the allowable lower limit voltage can be prevented, and therefore, there are provided a microwave oven and a method of controlling the same, with an improved output efficiency of the magnetron.

In addition, since abnormal current or over-current due to the falling of a thunderbolt or other geographical conditions, the stability of the circuit can be enhanced.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A microwave oven, comprising:

a magnetron;

a power supply part having an output for supplying AC power;

a high voltage transformer for generating a high voltage in response to the AC power from the power supply part, and for providing the high voltage to the magnetron;

a low voltage detector part connected to the output of the power supply part for determining when a voltage of the AC power supplied by the power supply part is lower than a predetermined allowable lower limit voltage; and a power controller part connected between an output of the low voltage detector part and an input of the power supply part for interrupting output of the AC power from the power supply part, and thus power supply to the magnetron, when it is determined that the voltage of the AC power supplied by the power supply part is lower than the predetermined allowable lower limit voltage.

2. The microwave oven according to claim 1, further comprising:

a rectifier and smoother part connected to the output of the power supply part for rectifying and smoothing the AC power to provide DC power;

an inverter part for converting the DC power from the rectifier and smoother part into AC power having a high voltage for provision to the high voltage transformer; and an inverter controller part for interrupting the power supply to the magnetron when it is determined that the voltage of the AC power supplied by the power supply part is lower than the predetermined allowable lower limit voltage.

3. The microwave oven according to claim 2, wherein the power controller part determines whether a current value of power inputted into the high voltage transformer exceeds a predetermined allowable current value, interrupts power supply to the magnetron when the current value is in excess of the predetermined allowable current value, and resumes operation of the magnetron after a predetermined period of time for recess has passed.

4. The microwave oven according to claim 3, wherein the power controller part counts a number of times that the AC power has been interrupted, determines whether the number of times that the AC power has been interrupted exceeds a predetermined number, and completely stops driving of the magnetron when the number of times that the AC power has been interrupted exceeds the predetermined number.

5. The microwave oven according to claim 2, wherein the power controller part interrupts power supply to the magnetron when a voltage of the AC power from the power supply part exceeds a predetermined allowable upper limit voltage.

6. The microwave oven according to claim 1, wherein the power controller part determines whether a current value of the AC power from the power supply part exceeds a predetermined allowable current value, interrupts the AC power from the power supply part when the current value is in excess of the predetermined allowable current value, and resumes operation of the magnetron after a predetermined period of time for recess has passed.

7. The microwave oven according to claim 6, wherein the power controller part counts a number of times that the AC power has been interrupted, determines whether the number of times that the AC power has been interrupted exceeds a predetermined number, and completely stops driving of the magnetron when the number of times that the AC power has been interrupted exceeds the predetermined number.

8. The microwave oven according to claim 1, wherein the power controller part interrupts power supply to the magnetron when a voltage of the AC power from the power supply part exceeds a predetermined allowable upper limit voltage.

9. The microwave oven according to claim 1, wherein the power controller part further comprises a comparator for comparing a voltage of the AC power from the power supply part with the predetermined allowable lower limit voltage to determine whether the voltage of the AC power from the power supply part is lower than the predetermined allowable lower limit voltage.

10. The microwave oven according to claim 1, further comprising a rectifier and smoother part connected to the power supply part for rectifying and smoothing the AC power from the power supply part, and a current detector part connected between an output of the rectifier and smoother part and an input of the power controller part for detecting when a current value of the AC power from the power supply part exceeds a predetermined allowable current value, said power controller part interrupting the AC power from the power supply part when the current value exceeds the predetermined allowable current value.

11. A method of controlling a microwave oven which includes a magnetron, a power supply part for supplying AC power, and a high voltage transformer for generating a high voltage with the AC power from the power supply part, said method comprising the steps of:

determining whether a voltage of the AC power from the power supply part is lower than a predetermined allowable lower limit voltage; and interrupting power supply to the magnetron when it is determined that the voltage of the AC power from the power supply part is lower than the predetermined allowable lower limit voltage.

12. The method according to claim 11, further comprising the steps of:

determining whether the voltage of the AC power from the power supply part exceeds a predetermined allowable upper limit voltage; and interrupting the power supply to the magnetron when it is determined that the voltage of the AC power from the power supply part exceeds the predetermined allowable upper limit voltage.

13. The method according to claim 12, further comprising the steps of:

determining whether a current value of power inputted into the high voltage transformer exceeds the predetermined allowable current value; and interrupting power supply to the magnetron when it is determined that the current value of the power is in excess of the predetermined allowable current value, and resuming operation of the magnetron after a predetermined period of time for recess has passed.

14. The method according to claim 11, further comprising the steps of:

determining whether a current value of power inputted into the high voltage transformer exceeds a predetermined allowable current value; and interrupting power supply to the magnetron when it is determined that the current value of the power is in excess of the predetermined allowable current value, and resuming operation of the magnetron after a predetermined period of time for recess has passed.

15. The method according to claim 11, wherein a comparator compares the voltage of the AC power from the power supply part with the predetermined allowable lower limit voltage to determine whether the voltage of the AC power from the power supply part is lower than the predetermined allowable lower limit voltage.

16. A microwave, comprising:

a magnetron;

a power supply part having an output for supplying AC power;

a high voltage transformer for generating a high voltage in response to the AC power from the power supply part, and for providing the high voltage to the magnetron; and a power controller part for determining whether a current value of the AC power from the power supply part exceeds a predetermined allowable current value, and for interrupting the AC power from the power supply part when the current value of the AC power from the power supply part exceeds the predetermined allowable current value.

17. The microwave oven according to claim 16, wherein the power controller part resumes operation of the magnetron after a predetermined period of time for recess, after interruption of the AC power from the power supply part, has passed.

18. The microwave oven according to claim 16, further comprising:

a rectifier and smoother part connected to the output of the power supply part for rectifying and smoothing the AC power to provide DC power;

an inverter part for converting the DC power from the rectifier and smoother part into AC power having a high voltage for provision to the high voltage transformer; and an inverter controller part for interrupting the power supply to the magnetron when it is determined that the voltage of the AC power supplied by the power supply part is lower than the predetermined allowable lower limit voltage.

19. The microwave oven according to claim 16, wherein the power controller part interrupts power supply to the magnetron when a voltage of the AC power from the power supply part exceeds a predetermined allowable upper limit voltage.

20. The microwave oven according to claim 16, wherein the power controller part comprises a comparator for comparing a voltage of the AC power from the power supply part with the predetermined allowable lower limit voltage to determine whether the voltage of the AC power from the power supply part is lower than the predetermined allowable lower limit voltage.

21. A microwave oven, comprising:

a magnetron;

a power supply part having an output for supplying AC power;

a high voltage transformer for generating a high voltage in response to the AC power from the power supply part, and for providing the high voltage to the magnetron;

a rectifier and smoother part connected to the output of the power supply part for rectifying and smoothing the AC power to provide DC power;

an inverter part for converting the DC power from the rectifier and smoother part into AC power having a high voltage for provision to the high voltage transformer; and an inverter controller part for interrupting the power supply to the magnetron when it is determined that the voltage of the AC power supplied by the power supply part is lower than the predetermined allowable lower limit voltage.

22. The microwave oven according to claim 21, further comprising a power controller part which determines whether a current value of the AC power from the power supply part exceeds a predetermined allowable current value, interrupts the AC power from the power supply part when the current value is in excess of the predetermined allowable current value, and resumes operation of the magnetron after a predetermined period of time for recess has passed.

23. The microwave oven according to claim 21, further comprising a power controller part which interrupts power supply to the magnetron when a voltage of the AC power from the power supply part exceeds a predetermined allowable upper limit voltage.

24. The microwave oven according to claim 21, further comprising a power controller part which includes a comparator for comparing a voltage of the AC power from the power supply part with the predetermined allowable lower limit voltage to determine whether the voltage of the AC power from the power supply part is lower than the predetermined allowable lower limit voltage.

* * * * *